US012152867B1

(12) United States Patent
Fries et al.

(10) Patent No.: US 12,152,867 B1
(45) Date of Patent: Nov. 26, 2024

(54) APPARATUS AND METHODS FOR PUSHING OUT AND DRILLING AN AERIAL FLARE

(71) Applicant: The United States of America, as represented by the Secretary of the Navy, Crane, IN (US)

(72) Inventors: Paul Fries, Owensburg, IN (US); Nicholas Uebelhor, Jasper, IN (US); Austin D. Schulte, Bloomfield, IN (US); Michael C. Jones, Loogootee, IN (US)

(73) Assignee: The United States of America, Represented by the Secretary of the Navy, Washington, DC (US)

( * ) Notice: Subject to any disclaimer, the term of this patent is extended or adjusted under 35 U.S.C. 154(b) by 29 days.

(21) Appl. No.: 18/142,609

(22) Filed: May 3, 2023

(51) Int. Cl.
*F42B 33/06* (2006.01)
*F42B 4/26* (2006.01)

(52) U.S. Cl.
CPC ..... *F42B 33/06* (2013.01); *F42B 4/26* (2013.01)

(58) Field of Classification Search
CPC .. F42B 33/06; F42B 35/00; F42B 4/26; F42B 99/00; G01N 1/04; G01N 2001/065; G01N 1/08
See application file for complete search history.

(56) References Cited

U.S. PATENT DOCUMENTS 4,160,314 A * 7/1979 Fridy ..... F42B 33/06 83/651.1
5,301,594 A * 4/1994 Argazzi ..... F42B 33/06 408/56
6,055,871 A * 5/2000 Gerber ..... F02K 9/96 83/167
7,640,858 B1 * 1/2010 Herbage ..... C06B 21/0041 102/336

* cited by examiner

*Primary Examiner* — J. Woodrow Eldred
(74) *Attorney, Agent, or Firm* — Naval Surface Warfare Center, Crane Division; Patrick Law

(57) ABSTRACT

Provided are systems, apparatus, and methods for pushing out and drilling a flare grain in an aerial flare. The system includes at least three stands including a first stand holding a first electric linear actuator positioned to interface with the aerial flare and push out a flare grain of the flare. The second stand holds the aerial flare and is positioned relative to the first stand to facilitate interface of the flare with the first electric linear actuator. The third stand includes a drill and is movable relative to the second stand for drilling a hole in the flare grain. A second electric linear actuator is coupled to the third stand device moves the third stand device relative the second stand to enable the drill to engage with the flare grain. The system also includes a controller/processor automating the pushing and drilling operations by controlling the electric linear actuators.

20 Claims, 7 Drawing Sheets

APPARATUS AND METHODS FOR PUSHING OUT AND DRILLING AN AERIAL FLARE

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200629US01) is assigned to the United States Government and is available for licensing for commercial purposes. Licensing and technical inquiries may be directed to the Technology Transfer Office, Naval Surface Warfare Center Crane, email: Crane_T2@navy.mil.

FIELD

The field of the present disclosure relates generally to apparatus and methods for pushing out and drilling an aerial flare, and more particularly to automated apparatus or methods for pushing out and drilling an aerial decoy flare grain including electrical actuation.

BACKGROUND

For devices such as aerial decoy flares, testing of the flare grain involves pushing the flare grain or similar pyrotechnic substance used in flares out of a flare housing (also referred to herein as a unit under test (UUT)) and then drilling a shallow hole in the flare grain for further testing. This testing is typically for ordnance assessment or life cycle testing of in-service flare grains where items are taken out of inventory and evaluated. Known procedures for testing aerial decoy flares involve fully pushing the flare grain out of the flare housing with a pneumatically operated fixture. The pushed out flare grain is then transported to another fixture for drilling a shallow hole in the flare grain, which may be performed by another pneumatically operated fixture. Since these procedures are typically performed outdoors at ordnance test areas or ranges during cold weather conditions, for example, the moisture in the pneumatic lines tends to freeze causing safety concerns and production delays.

SUMMARY

The present disclosure provides a flare grain push out and drilling apparatus that does not rely on pneumatics, but rather electro-mechanical actuators, and also affords a singular apparatus such that flare grains do not need to be transported after being pushed out from a flare housing. In one aspect, the apparatus includes a base and three stands, of which two are stationary and one movable stand with a drill attached that is moved forward and reverse using a first linear actuator. One of the stands is a center stand that holds an encased test sample using a fixture designed to keep the sample stationary while the flare grain or composition is pushed by another second linear actuator towards the drill. Both linear actuators may be implemented with electromechanical devices that are controllable with a programmable controller (or similar microprocessor based controller) affording quicker and safer testing of flare grains.

Additional features and advantages of the present invention will become apparent to those skilled in the art upon consideration of the following detailed description of the illustrative embodiments.

BRIEF DESCRIPTION OF THE DRAWINGS

The detailed description of the drawings particularly refers to the accompanying figures in which.

DETAILED DESCRIPTION

The examples described herein are not intended to be exhaustive or to limit the invention to precise forms disclosed. Rather, the embodiments selected for description have been chosen to enable one skilled in the art to practice the invention.

The present disclosure provides an apparatus that affords the ability to push a flare grain composition of an aerial decoy flare out of the flare case, and also drill a shallow hole in the end of the flare grain composition to facilitate attachment of a base or other stand thereto for further testing. This present apparatus utilizes electric linear actuators (i.e., electromechanical linear actuators) rather than other mechanical devices such as pneumatic actuators, which affords at least the ability to operate the apparatus in the field even when temperatures are lower, such as below freezing (0° C.).

Figure 1:
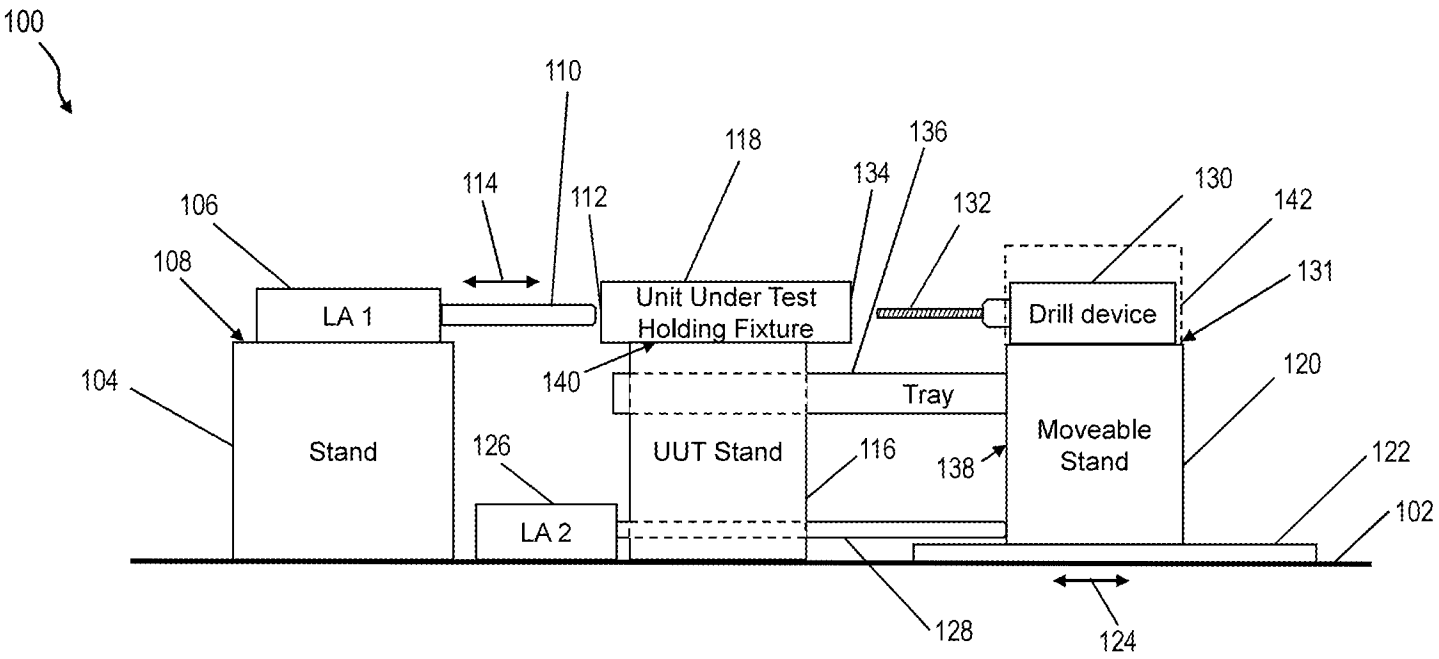
FIG. 1 shows a side or elevation view of an apparatus for pushing out a flare grain or composition and drilling the same according to aspects of the present disclosure.

FIG. 1 illustrates a side view of one example of an apparatus 100 for pushing a flare grain composition of an aerial decoy flare out of the flare case, and also for drilling a hole in the end of the flare grain composition for facilitating attachment of a base or stand to the flare grain composition for further testing. The apparatus 100 includes a base 102 (or an equivalent device/structure providing underlying support) upon which other components of the apparatus 100 are mounted or disposed. A first stand 104 disposed on base 102 has, in turn, a first linear actuator 106 (also labeled LA 1) disposed on a top portion 108 thereof. The first linear actuator 106 includes a push rod 110 having a predetermined throw distance or dimension configured to align with and contact a first end of aerial decoy unit under test (UUT) as shown at 112 and exert a pushing force thereupon to push the flare grain from the case, which will be discussed in more detail below. In further aspects, the first linear actuator 106 is also configured to extend or retract the push rod 110 in a generally lateral or horizontal direction as indicated by double-headed arrow 114. In an aspect, the first linear actuator 106 may be configured with a twelve inch throw (i.e., stroke distance) and a 2000 pound rated load or force capacity, but the disclosure is not limited to such and the stroke and the rated load or force may be configured for various different aerial decoy flares and configurations of the apparatus 100. Additionally, the first linear actuator 106 is an electromechanical linear actuator (also known as electric linear actuator) in certain aspects. In further aspects, the first linear actuator embodied as an electric liner actuator may be operable using either alternating current (AC) or direct current (DC) at various preselected voltages dependent on the selected power source for the apparatus 100.

Apparatus 100 also includes a second stand 116 (also termed herein as a "center stand" as stand 116 is positioned between the first stand 104 and a third stand 120 to be discussed below) disposed or affixed on the base 102. The center or second stand 116, which is also termed a UUT stand, includes a UUT test holding fixture 118 disposed or affixed to a top portion of the UUT stand 116. The UUT test holding fixture 118 is configured to receive and hold an aerial decoy flare (or UUT), which is not illustrated in FIG. 1. In one example, the second stand 116 may include mounting holes drilled in a top portion thereof to facilitate mounting various holding fixtures (e.g., 118) each configured for respective aerial flare cases or equivalent means for interchangeably mounting various different holding fixtures such as clamps, quick release bolts, interlocking parts, etc.

Apparatus 100 further includes a moveable third stand 120, which is configured to be movable with respect to the base 102 and, in turn, with respect to the second or center stand 116. In one example, the third stand 120 may be mounted on a complementary rail, conveyor, or track 122 affixed to the base 102 allowing the third stand 120 to move along the rail 122 lateral or parallel relative to the base 102 as indicated by direction arrow 124. The third stand 120 is mechanically coupled with a second linear actuator 126 (LA 2) via the actuator rod 128 of linear actuator 126, which moves the third stand 120 laterally in the directions indicated by arrow 124. It is noted that in the embodiment illustrated in FIG. 1, the second linear actuator 126 is disposed or affixed on based 102, and further positioned such that the actuator arm 128 passes through an opening or aperture in second stand 116 (indicated by dashed lines for a portion of the arm 128). It is noted that this placement is merely exemplary and the second linear actuator 126 may be positioned on the other side of the second stand 116 (i.e., to the right of stand 116 in the drawing) in other embodiments. In one aspect, the second linear actuator 126 may be configured with a twelve inch throw (i.e., stroke distance) for the actuator arm 128 and a 2000 pound rated load or force capacity, but the disclosure is not limited to such and the stroke and the rated load or force may be configured for various different aerial decoy flares and configurations of the apparatus 100. Additionally, in certain aspects the second linear actuator 126 is configured as an electromechanical linear actuator (also known as electric linear actuator). In further aspects, the second linear actuator embodied as an electric liner actuator may be operable using either alternating current (AC) or direct current (DC) at various preselected voltages dependent on the selected power source for the apparatus 100.

The movable third stand 120 includes a drilling device 130 disposed on or affixed to a top portion 131 thereof. The drilling device includes a drill bit 132 or equivalent rotary cutting apparatus that is positioned to engage a second end portion of a flare grain (located at 134 but not specifically illustrated as the aerial flare is located in and held by holding fixture 118). When operated, the drilling device 130 and the drill bit 132, in particular, is brought into contact with the flare grain and drills a hole therein of a predetermined diameter and length dependent on the drill bit size and the distance linear actuator 126 moves the moveable third stand 120. In one embodiment, the drilling device 130 may be implemented with a Milwaukee magnetic drill press motor model number 6Z293, but is not limited to such.

According to still further aspects, the moveable third stand 120 may also include a fixed catch tray 136 having a proximate end affixed to a side 138 of the stand 120 and extending therefrom. The catch tray 136 is configured to catch an end cap of the flare that is located at end 134 of the flare and is initially pushed off by the force exerted on the flare grain at end 112 by the push rod 110 that is, in turn, transferred to end 134 since the flare grain is relatively solid. Furthermore, the catch tray 136 is configured to catch a sample (i.e., the flare grain after a hole is drilled therein by the drill device 130) and any explosive composition shavings created during the drilling process. As illustrated in FIG. 1, the catch tray 136 may travel under a top portion 140 of the second stand 116 and below the flare holding fixture 118 as the second stand 116 moves.

In yet further aspects, apparatus 100 may include a drill shield 142 that encloses or surrounds the drill device 130. The drill shield 142 helps to shield the explosive compositions of the flare grain from sparks that may occur in the electric motor of the drill device 130.

Figure 2:
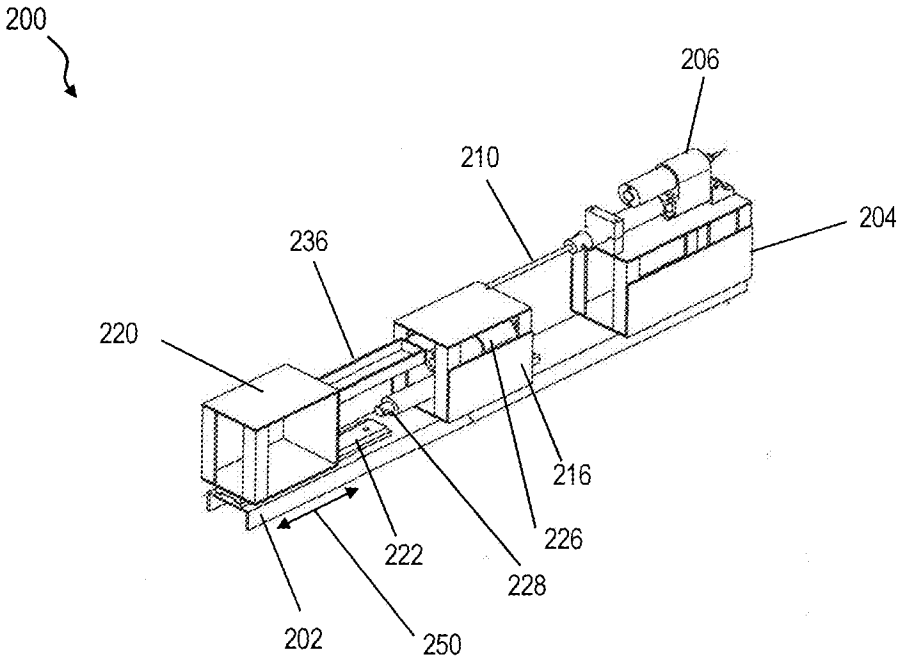
FIG. 2 shows a tri-metric view of another example of an apparatus for pushing out a flare grain or composition and drilling the same according to aspects of the present disclosure.

FIG. 2 shows a tri-metric view of another exemplary embodiment of an apparatus 200 for pushing a flare grain composition of an aerial decoy flare out of the flare case, and also for drilling a hole in the end of the flare grain composition for facilitating attachment of a base or stand to the flare grain composition for further testing. It is noted that numbering of elements in the tens places in this example is used to illustrate correlation of similar parts and functionalities (but not necessarily identical parts) of the apparatus 200 to the apparatus 100 (e.g., rail 102 correlates to rail 202, stand 104 correlates to stand 204, etc.).

As shown in FIG. 2, the apparatus 200 includes a base 202 upon which various elements are mounted. The apparatus 200 includes a first stand 204 mounted or affixed to the base 202. The first stand 204 has a first electric linear actuator 206 mounted to a top portion thereof. The first electric actuator 206 includes a throw arm or push rod 210 that is configured to engage with an aerial flare device (i.e., a UUT) housed in a flare holding fixture (not shown) mounted to a top portion of a second or center stand 216.

Furthermore, the apparatus 200 includes a third movable stand 220 that is mounted on a rail or track 222 allowing movement of the stand 220 along or parallel with the longitudinal axis 250 of the base 202 toward or away from the second or center stand 216. Although not shown, a drilling device (and an accompanying drilling device shield)

may be mounted on a top portion of the third movable stand 220 for engaging with and drilling a hole within a flare grain being held on the second stand 216. Similar to apparatus 100, the third movable stand 220 may be moved using a second electric linear actuator 226, which is coupled to the third movable stand with a push rod or throw 228 (not shown coupled to the third movable stand 220 in this illustration). Furthermore, the third movable stand 220 may include a catch tray 236 affixed thereto.

In aspects, the second or center stand 216 may be constructed such that at least a portion of the second electric linear actuator 226 is housed or enclosed by the stand 216 as shown in the example of FIG. 2. Moreover, the second or center stand 216 may be configured with an opening or space that allows the tray 236 to pass through the stand 216 in order to position the tray 236 underneath at least a portion of the aerial flare grain in order to catch an end cap of the aerial flare pushed out by push rod 210, as well as catch a sample (i.e., the flare grain after a hole is drilled therein by the drill device) and any explosive composition shavings created during the drilling process.

Figure 3B:
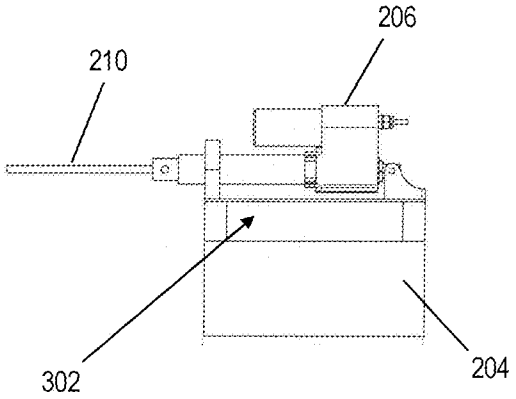
FIG. 3B shows a side or elevation view of the exemplary actuator and actuator stand of FIG. 3A that may be used with the apparatus of FIG. 2 according to aspects of the present disclosure.
Figure 3A:
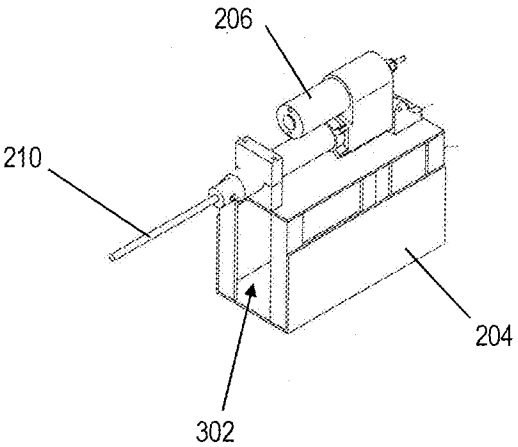
FIG. 3A shows a tri-metric view of an exemplary actuator and actuator stand that may be used with the apparatus of FIG. 2 according to aspects of the present disclosure.

FIG. 3A shows a tri-metric view of the exemplary actuator 206 and first (or actuator) stand 204 used with the apparatus of FIG. 2 according to aspects of the present disclosure. As may be seen, the stand 204 may be constructed to include an interior hollow or open volume 302 in order to save materials and reduce weight of the apparatus 200. FIG. 3B further shows a side or elevation view of the exemplary actuator 206 and first (or actuator) stand 204 of FIG. 3A that may be used with the apparatus of FIG. 2.

Figure 4C:
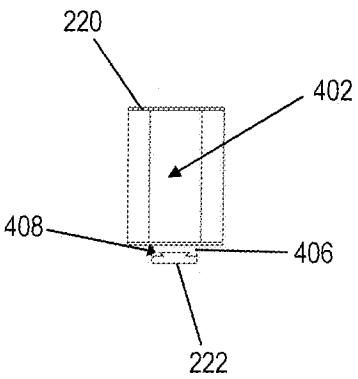
FIG. 4C shows an end elevation view of the exemplary movable stand of FIG. 4A that may be used with the apparatus of FIG. 2 according to aspects of the present disclosure.
Figure 4B:
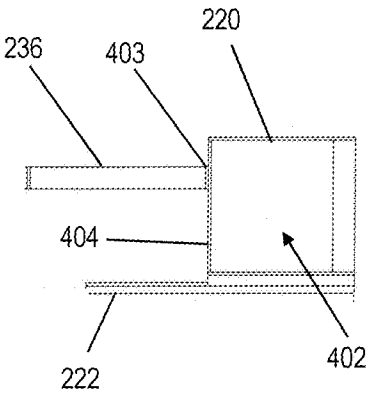
FIG. 4B shows a side elevation view of the exemplary movable stand of FIG. 4A that may be used with the apparatus of FIG. 2 according to aspects of the present disclosure.
Figure 4A:
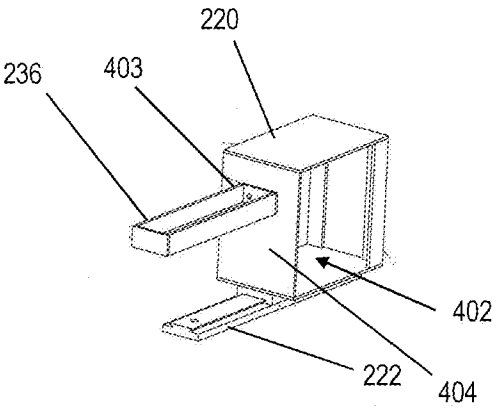
FIG. 4A shows a tri-metric view of an exemplary movable stand for a drilling device that may be used with the apparatus of FIG. 2 according to aspects of the present disclosure.

FIG. 4A shows a tri-metric view of an exemplary movable stand (i.e., stand 220) for mounting a drilling device and attendant rail/track 222 that may be used with the apparatus of FIG. 2 according to aspects of the present disclosure. As illustrated, the movable stand 220 may be constructed to include an interior hollow or open volume 402 in order to save materials and reduce weight of the apparatus 200. Additionally, FIG. 4A illustrates one exemplary construction where the catch tray 236 is mounted or affixed at a proximate end 403 to a vertical wall or vertical portion 404 of the movable stand 220 and extending generally perpendicularly or orthogonally therefrom. FIG. 4B shows a side elevation view of the exemplary movable stand 220 of FIG. 4A.

FIG. 4C shows an end elevation view of the exemplary movable stand 220 of FIGS. 4A and 4B that may be used with the apparatus of FIG. 2. As may be seen in this view, the moveable stand 220 is mounted upon rail 222, which allows movement in the same longitudinal axis as base 202 (not shown). In further aspects, the stand 220 may include a rail engagement portion 406 on a bottom side that engages with and interlocks with the rail 222 to prevent lateral movement of the stand 220 perpendicular to the rail 222 and base 202. As further illustrated in FIG. 4C, the rail engagement portion 406 may be configured with a shape that is complementary to the shape of the rail 222 including indent portions (e.g., 408) defining a keystone shape or other shapes affording interlocking of the rail engagement portion 406 and rail 222 to maintain a fixed movement direction while inhibiting lateral motion to ensure that the drilling device mounted thereon aligns with the flare grain to be drilled.

Figure 5:
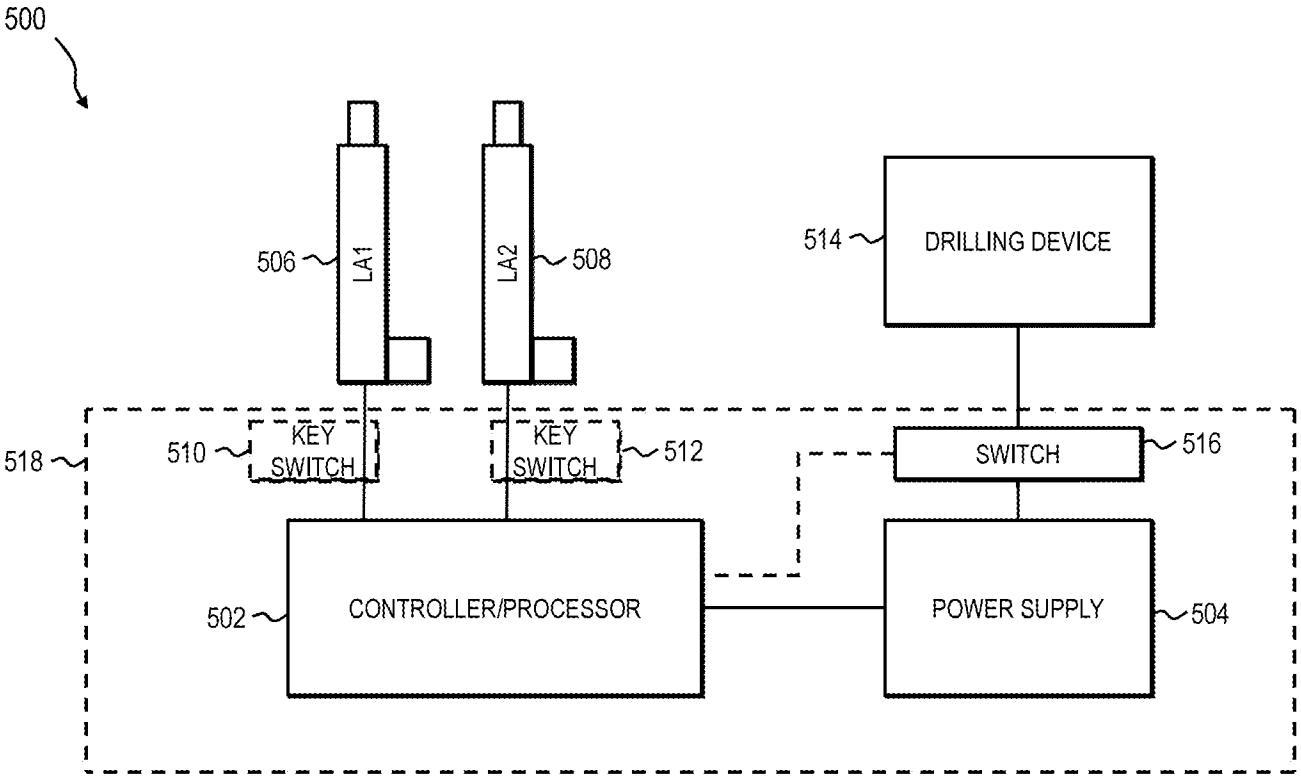
FIG. 5 shows an exemplary circuitry diagram that may be utilized with the apparatus of FIGS. 1 and 2 according to aspects of the present disclosure.

FIG. 5 shows an exemplary block diagram of circuitry 500 that may be utilized with the apparatus of FIGS. 1 and 2 according to aspects of the present disclosure. As shown, the circuitry 500 includes a controller or processor 502 that controls the operation of the various elements of the system (e.g., system being synonymous for apparatus 100 or apparatus 200). In aspects, the controller 502 may be implemented with a microcontroller or a microprocessor and may further include a memory (not shown) that contains stored instructions executable by the processor 502 for operation of the system. Additionally, the controller 502 may include an interface or inputs (not shown) allowing for programming or re-programming of the system. As examples, the controller 502 may be implemented with dedicated controllers such as prop controllers or other programmable controllers controlling switches or relays (e.g., a PicoBoo Plus controller that is used for controlling props), a Raspberry Pi device, or more complex controllers, or even an application-specific integrated circuit (ASIC), as examples. The controller 502 is further coupled with a power supply 504, which supplies power for the controller 502, as well as other devices in the system as will be discussed below.

As further illustrated, the controller 502 is coupled to the linear electric actuators 506 and 508 (e.g., LA 1 and LA2 corresponding to actuators 106, 206 and 116, 226, respectively) to control the operation thereof. In particular, the controller is configured in some embodiments to operate the linear electric actuators 506 and 508 in specific directions and at specific times/sequences. Additionally, circuitry 500 may further include optional key switches 510 and 512 in series with the electrical couplings between eh controller 502 and the linear actuators 506, 508 as safety locks to prevent the pushing/drilling operation unless authorized and/or a safety check of the area has been performed. In particular, it is noted that safety necessitates the removal of power to the controller while an unprotected operator is in the proximity of the fixture. Removal of power from the controller 502, however, may negate the programming function of the controller depending on the type of controller used. Accordingly, the use of keyed switches 510, 512 at least on the positive voltage wires between the controller and the linear actuators ensures that the linear electric actuators 506, 508 are inoperable. Thus, in some aspects an operator can be required to turn off the switches 510, 512, remove the keys, and then perform whatever operation is required near the fixture, re-insert the keys to close the switches 510, 512, and then continue operations.

In other aspects, it is noted that power supply 504 may be embodied as an AC and/or DC power supply that is powered by either an external source of power such as AC power from a generator or from stored energy sources such as one or more DC batteries. The power supply may include inverters to convert DC sources to AC, as well as converters to convert AC to DC. Furthermore, the power supply 504 may include current rectifiers and/or voltage regulators or converters to convert AC voltages/currents to DC voltages/currents or the increase/reduce DC to DC voltages. In still further aspects, the drill device may be configured as a DC device (e.g., 12 Volts DC powered).

The power supply 504 may also power the drilling device 514. Furthermore, the drilling device 514 may be turned on or off manually with a switch 516, which may be a single pole/single throw switch rated for the voltage/current of the drilling device 514 in one embodiment. In other embodiments, switch 516 may be a controllable power switch, such as with a power field effect transistor (FET) as one example, which is switchable by a supplied input voltage or current. In yet further embodiments, if the switch 516 is controllable, the controller 502 may selectively control operation of switch 516 as illustrated by the dashed connection between controller 502 and switch 516. For example, the control operation of the drilling device 514 by controller 502 via switch 516 may be implemented according to a predetermined drilling process coordinated with operation of the second electric linear actuator 508 (or 126 or 226) that moves the third stand holding the drilling device 514. In a further example, the drilling device 514 may be turned on after the second linear actuator (e.g., 126, 226, 508) has moved the third stand (and drilling device) into close proximity of the flare grain to be drilled. Additionally, the controller 508 may be configured to run the drilling device for a predetermined period of time as the second linear actuator continues to move the third stand toward the second stand and, hence, the flare grain, in order to drill a hole of a predetermined length.

In further aspects, easy transportation of the controller/processor 502, power supply 504, switches 510, 512, and 516 and associated wiring between these elements may be desirable. Accordingly, these components may be contained within a housing or case illustrated by dashed line 518. In one embodiment, a hard case may be employed such as a Pelican™ case. In yet further embodiments, the controller and electrical box may be attached or affixed to inner surfaces of the case. In still further aspects, the case 518 may be configured with apertures or access ports to allow access to internal components (e.g., key switches 510, 512 and controller 502) without opening of the case 518.

Figure 6:
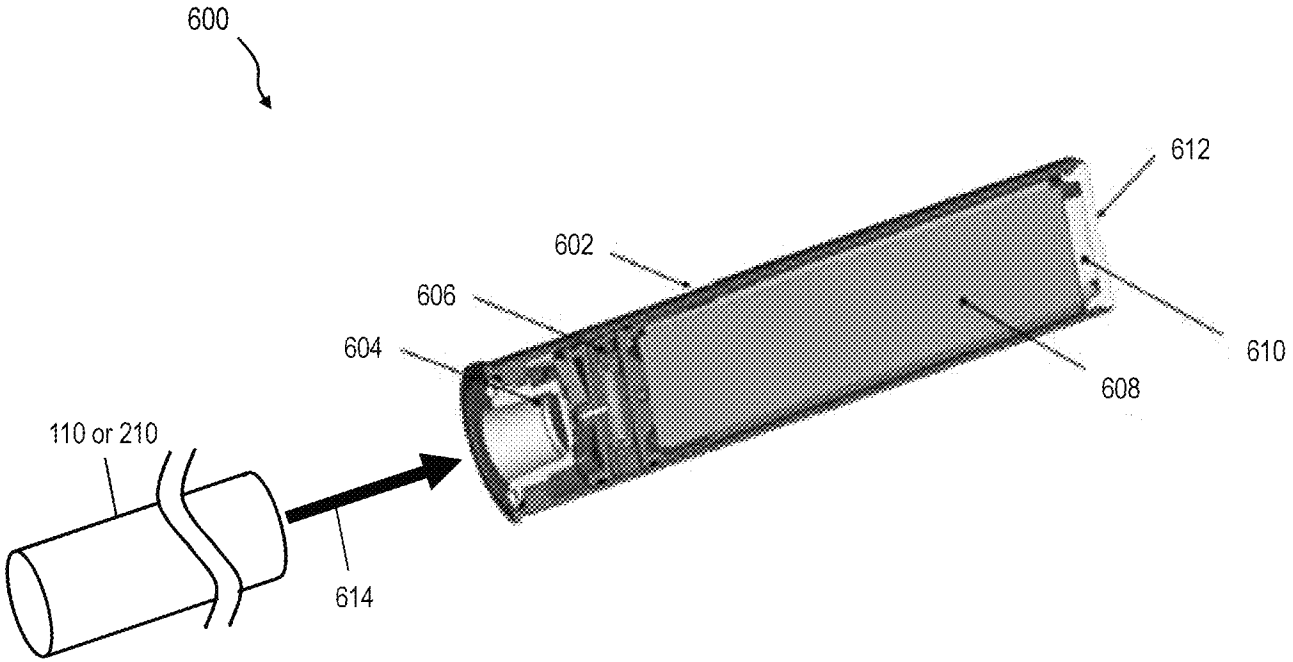
FIG. 6 shows a tri-metric view of one example of an aerial decoy flare that may be used with the apparatus of FIGS. 1 and 2 and held within the UUT stands according to aspects of the present disclosure.

FIG. 6 shows a tri-metric view of one example of an aerial decoy flare 600 that may be used with the apparatus of FIGS. 1 and 2 and held within the UUT stands (e.g., 116 and associated UUT test holding fixture 118 or stand 216) according to aspects of the present disclosure. The flare 600 may include a case 602, an I/C cup or plug 604, an igniter 606, a flare grain 608, a compression pad 610 and an end cap 612 (which is referred to herein as the "end cap"). As further illustrated, the push or throw rod (e.g., 110 or 210) of the first linear actuator will contact and apply a force 614 to plug 604 to cause the flare grain 608 to be pushed out of the case 602, as well as push off the end cap 612 (and pad 610 as well in this particular example). Additionally, in some aspects the push or throw rod 110, 210 can be left in place in contact with plug 604 after first pushing of at least a portion of the flare grain 608 out of the case 602 during the drilling operation. This acts to apply an opposing force on plug 604 to oppose the drilling device and force applied by the second linear actuator to ensure that the flare grain 608 is stationary and/or immovable during the drilling operation.

Figure 7:
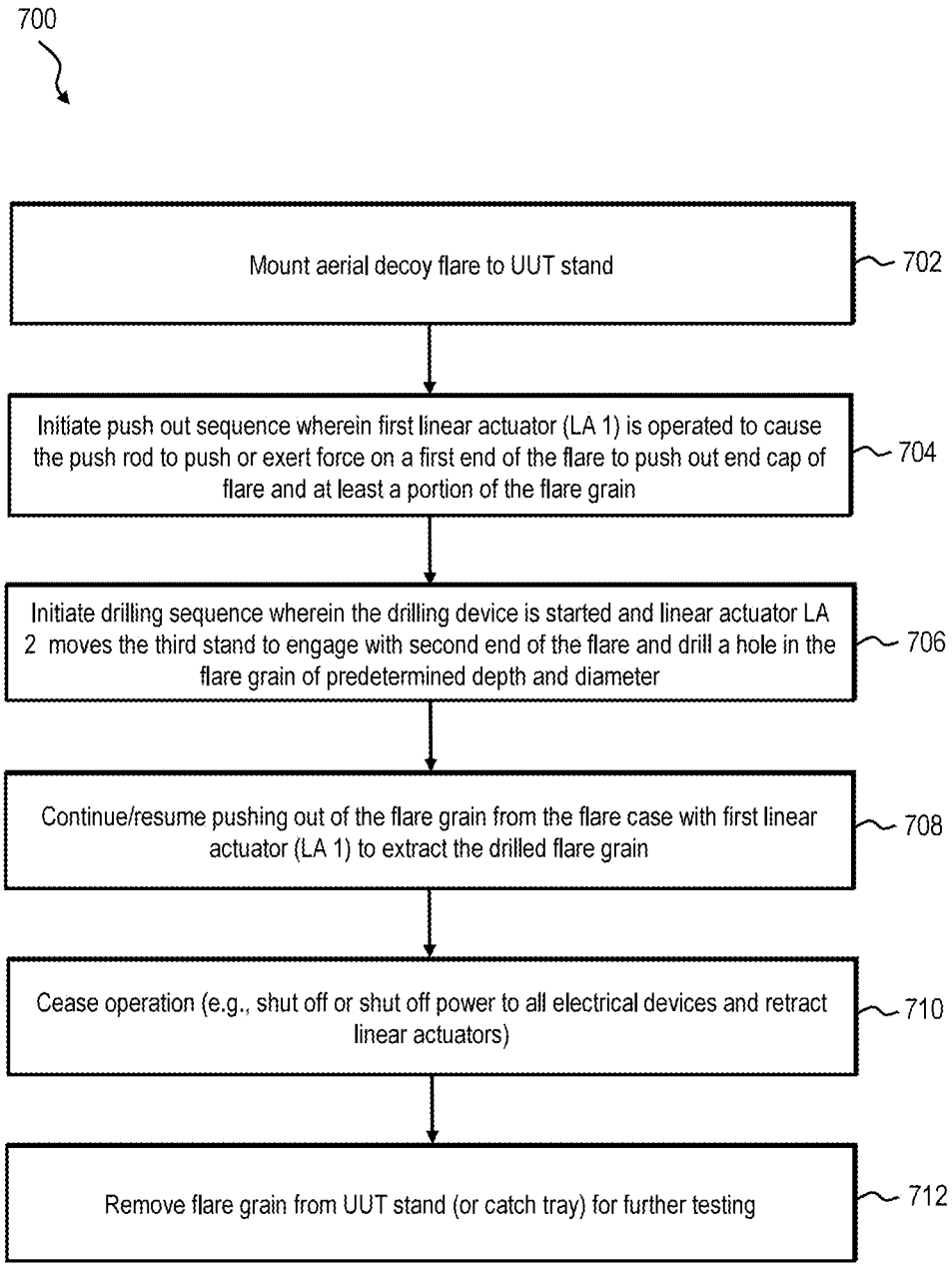
FIG. 7 shows a flow diagram of an exemplary method for pushing a flare grain composition of an aerial decoy flare out of a flare case or casing, and also drilling a shallow hole in the end of the flare grain according to aspects of the present disclosure.

FIG. 7 shows a flow diagram of an exemplary method 700 for pushing a flare grain composition of an aerial decoy flare out of a flare case, and also drilling a hole in the end of the flare grain according to aspects of the present disclosure. As indicated before, a main procedure carried out by the disclosed systems and/or apparatus is to push at least a portion of the flare grain composition out of the case of an aerial decoy flare, and drill a shallow hole in the end (e.g., the other end of the flare opposite to the side being pushed) to facilitate attachment of a base for further testing. The procedure further includes pushing the flare grain fully out of the case with the first linear actuator (e.g., 106, 206, or 506) for retrieval by an operator (note—this may include pushing into the catch tray 136 or 226).

Turning to FIG. 7, method 700 includes mounting an aerial decoy flare to the unit under test (UUT) stand (e.g., stands 116 or 216) as shown in block 702. Next, the system (e.g., controller 502) may then initiate a push out sequence wherein the first electric linear actuator (e.g., LA 1 (106, 206, or 506)) is operated to cause the push rod of the linear actuator to act upon, push, or exert a pushing force on a first end of the flare to push out an end cap of the flare, flare casing, or flare body, as well as at least a portion of the flare grain within the flare body or casing as indicated in block 704.

Next, method 700 includes initiating a drilling sequence wherein drilling device (e.g., 130 or 514) is started and a second linear actuator (e.g., LA 2 (126, 226, or 508)) moves the third stand (e.g., 120 or 220) to engage with a second end of the flare (and flare grain) and drill a hole in the flare grain of a predetermined depth and diameter as shown in block 706. The processes of block 706 may include implementing a predetermined drilling process, such as via controller 502, the process including operating the drilling device for a predetermined time period and operating the second electric linear actuator to cause the third movable stand to move toward the second stand at a predetermined rate and distance in order to drill a hole in the flare grain. Furthermore, the processes of block 706 may also include maintaining the push rod (110 or 210) in position at the other end of the aerial flare to maintain an opposing force to the force of the third stand applied by the second linear actuator and drilling device such that the flare grain is held immobile during drilling. After the processes of block 706, the third movable stand may be retracted to then allow operation of the first linear actuator and associated throw rod (110, 210) to continue or resume applying pushing force to then fully push the now drilled flare grain out of the case of the aerial flare, such as into the catch tray (136, 236) as shown by block 710.

Finally, the controller (e.g., 502) may be programmed to cease operation, which may also include retraction of the push rod of the first linear actuator, shutting off the drilling device, moving the third stand back to an original position away from the second stand, and shutting off power/voltage to all electrical devices as shown in block 710. This then allows an operator to the safely retrieve and remove the flare grain from the UUT stand (or catch tray 136 or 236) for further testing as shown in block 712.

As those skilled in the art will appreciate, the present apparatus and methods allow for pushing out the flare grain and drilling a hole using solely electrical actuators and automation outdoors during cold weather conditions when moisture in other systems using pneumatic lines, for example, tends to freeze causing safety concerns and production delays. In addition, the present apparatus affords for both pushing out of the flare grain and drilling as opposed to the flare grain simply pushed out of the case requiring an operator to pick up the flare grain and, in turn, then have to set it up to be drilled. Accordingly, the disclosed combination of the two processes (pushout/drilling) eliminates the hazards inherent with hands on repositioning of raw explosive compositions between the push-out machine and the drilling operation.

Although the invention has been described in detail with reference to certain preferred embodiments, variations and modifications exist within the spirit and scope of the invention as described and defined in the following claims.

The invention claimed is:

1. A system for pushing out and drilling of a flare grain in an aerial flare comprising:

a first stand mounted to a base and configured to hold a first electric linear actuator with a throw rod positioned to interface with a first end of an aerial flare and exert a force on a first end of a flare grain within the aerial flare to cause the flare grain to move relative to a case of the aerial flare;

a second stand mounted to the base and configured to receive and fixedly hold the aerial flare;

a third stand mounted to the base and configured to be movable relative to at least the second stand and the aerial flare and further including a drilling device attached thereto;

a second electric linear actuator coupled to the third stand and configured to move the third stand and the attached drilling device relative to a second end of the flare grain to engage the drilling device with the second end of the flare grain for drilling a hole in at least one portion of the flare grain; and a controller electrically coupled to the first and second electric linear actuators and configured to control the first and second electric linear actuators according to a predetermined sequence of operation.

2. The system of claim 1, wherein the third stand further includes a catch tray affixed thereto and configured to be located under at least the second end of the aerial flare when the third stand is moved toward the second stand for drilling the hole in the at least one portion of the flare grain.

3. The system of claim 2, wherein the second stand is configured with an opening allowing the catch tray to pass through the second stand and be positioned under at least the second end of the aerial flare.

4. The system of claim 1, wherein the predetermined sequence includes:

operating the first electric linear actuator by the controller to exert the force on first end of the flare grain to cause an end cap of the aerial decoy located at the second end of the flare grain to be pushed off and expose the flare grain and also cause the flare grain to be at least partially pushed out of the case of the aerial flare at the second end of the aerial flare; and operating the second electric linear actuator after operating the first electric linear actuator to cause the drilling device to contact the flare grain at the second end of the aerial flare and to drill the hole in the at least one portion of the flare grain.

5. The system of claim 4, further comprising:

operating the first linear actuator after operating the second linear actuator and the drilling device to fully push the flair grain out of the case of the aerial flare.

6. The system of claim 1, wherein the controller is further configured to control operation of the drilling device according to a predetermined drilling process coordinated with operation of the second electric linear actuator.

7. The system of claim 6, wherein the predetermined drilling process includes operating the drilling device for a predetermined time period and operating the second electric linear actuator to cause the third movable stand to move toward the second stand at a predetermined rate and distance.

8. The system of claim 1, wherein the third stand further comprises a rail disposed between an upper portion of the third stand and the base and configured to allow the third stand to move relative to the base.

9. An apparatus configured for pushing out and drilling a flare grain in an aerial flare, the apparatus comprising:

a base;

a first stand mounted to the base and including a first electric linear actuator with a throw rod positioned to interface with a first end of an aerial flare and exert a force on a first end of a flare grain within the aerial flare to cause the flare grain to move relative to a case of the aerial flare;

a second stand mounted to the base and configured to receive and fixedly hold the aerial flare;

a third stand mounted to the base and movable relative to at least the second stand, the third stand further including a drilling device attached to a top portion thereof;

a second electric linear actuator coupled to the third stand and configured to move the third stand and the attached drilling device relative to a second end of the flare grain to engage the drilling device with the second end of the flare grain for drilling a hole in at least one portion of the flare grain; and a processor communicatively coupled to the first and second electric linear actuators and configured to control the first and second electric linear actuators according to a pre-programmed sequence of operation.

10. The apparatus of claim 9, wherein the third stand further includes a catch tray orthogonally affixed to a vertical wall portion of the third stand and configured to be located under at least the second end of the aerial flare when the third stand is moved toward the second stand for drilling the hole in the at least one portion of the flare grain.

11. The apparatus of claim 10, wherein the second stand is configured with an opening allowing the catch tray to pass through the second stand and be positioned under at least the second end of the aerial flare.

12. The apparatus of claim 9, wherein the predetermined sequence includes the processor:

operating the first electric linear actuator by the controller to exert the force on first end of the flare grain to cause an end cap of the aerial decoy located at the second end of the flare grain to be pushed off and expose the flare grain and also cause the flare grain to be at least partially pushed out of the case of the aerial flare at the second end of the aerial flare; and operating the second electric linear actuator after operating the first electric linear actuator to cause the drilling device to contact the flare grain at the second end of the aerial flare and to drill the hole in the at least one portion of the flare grain.

13. The apparatus of claim 12, further comprising:

operating the first linear actuator after operating the second linear actuator and the drilling device to fully push the flair grain out of the case of the aerial flare.

14. The apparatus of claim 9, wherein the processor is further configured to control operation of the drilling device according to a predetermined drilling process coordinated with operation of the second electric linear actuator.

15. The apparatus of claim 14, wherein the predetermined drilling process includes the processor operating the drilling device for a predetermined time period and operating the second electric linear actuator to cause the third movable stand to move toward the second stand at a predetermined rate and distance.

16. The apparatus of claim 9, further comprising a shield mounted to the third stand and configured to encompass the drilling device to shield the flare grain from electric arcs or sparks that occur in the drilling device.

17. A method for pushing out and drilling of a flare pyrotechnic substance of an aerial flare comprising:

mounting an aerial decoy flare to a unit under test (UUT) stand;

initiating a push out sequence wherein a first electric linear actuator is operated to cause a push rod of the first electric linear actuator to exert a pushing force on a first end of the flare to push out an end cap of flare, as well as push at least a portion of the flare pyrotechnic substance of a casing of the flare;

initiating a drilling sequence wherein a drilling device is started and a second linear electric actuator is operated to move a movable stand holding the drilling device to engage with a second end of the flare and the flare pyrotechnic substance to drill a hole in the flare pyrotechnic substance of a predetermined depth and diameter; and ceasing powering of all electrical devices including the first and second electric linear actuators and the drilling device to allow retrieval of the drilled flare pyrotechnic substance.

18. The method of claim 17, further comprising:

operating the first linear actuator after operating the second linear actuator and the drilling device to fully push the flair grain out of the case of the aerial flare.

19. The method of claim 17, further comprising:

operating the drilling device for a predetermined time period and operating the second electric linear actuator to cause the movable stand to move toward the UUT stand at a predetermined rate and distance in order to drill the hole in the flare pyrotechnic substance.

20. The method of claim 17, wherein ceasing powering of all electrical devices further includes retraction of the push rod of the first linear actuator and moving the movable stand back to an original position away from the UUT stand prior to shutting off power or voltage to all the electrical devices.

* * * * *